United States Patent [19]

Lonstrup et al.

[11] 4,173,540

[45] Nov. 6, 1979

[54] LUBRICATING OIL COMPOSITION CONTAINING A DISPERSING-VARNISH INHIBITING COMBINATION OF POLYOL ESTER COMPOUND AND A BORATED ACYL NITROGEN COMPOUND

[75] Inventors: Thor F. Lonstrup, Plainfield; Darrell W. Brownawell, Scotch Plains; Barry J. Howlett, Westfield, all of N.J.

[73] Assignee: Exxon Research & Engineering Co., Florham Park, N.J.

[21] Appl. No.: 838,543

[22] Filed: Oct. 3, 1977

[51] Int. Cl.[2] ..... C10M 1/10

[52] U.S. Cl. ..... 252/49.6; 252/51.5 A

[58] Field of Search ..... 252/49.6

[56] References Cited

U.S. PATENT DOCUMENTS

| | | | |
|---|---|---|---|
| 3,125,527 | 3/1964 | Krug et al. | 252/49.6 |
| 3,254,025 | 5/1966 | LeSuer | 252/49.6 X |
| 3,272,746 | 9/1966 | LeSuer | 252/47.5 |
| 3,282,955 | 11/1966 | LeSuer | 252/49.6 |
| 3,284,410 | 11/1966 | Meinhardt | 252/49.6 |
| 3,322,670 | 5/1967 | Burt et al. | 252/49.6 |
| 3,338,832 | 8/1967 | LeSuer | 252/49.6 |
| 3,381,022 | 4/1968 | LeSuer | 260/404.8 |
| 3,385,791 | 5/1968 | Colyer et al. | 252/49.6 |
| 3,533,945 | 10/1970 | Vogel | 252/49.6 |

*Primary Examiner*—Delbert E. Gantz
*Assistant Examiner*—Andrew Metz
*Attorney, Agent, or Firm*—Roland A. Dexter; Frank T. Johmann

[57] ABSTRACT

The combination of an oil-soluble polyol ester reaction product having a number average molecular weight ($\overline{M}_n$) of from about 1,300 to 8,000, e.g., the reaction product of polybutenyl succinic anhydride with pentaerythritol which reaction product can be borated, if desired, and an oil-soluble acylated nitrogen compound having a ($\overline{M}_n$) of from about 1,300 to 8,000, e.g. polybutenyl succinic anhydride reacted with an alkylene polyamine such as tetraethylene pentamine, which nitrogen compound can be borated, if desired, are surprisingly useful as combined additives for lubricating oils to increase the dispersancy and varnish inhibition properties of said oil when one part per weight of said polyol ester reaction product is combined with from 0.2 to 4, preferably 1 to 3, parts by weight of said acylated nitrogen compound.

6 Claims, No Drawings

LUBRICATING OIL COMPOSITION CONTAINING A DISPERSING-VARNISH INHIBITING COMBINATION OF POLYOL ESTER COMPOUND AND A BORATED ACYL NITROGEN COMPOUND

BACKGROUND OF THE INVENTION

The invention relates to a combination of a polyol ester oil additive and an imide oil additive which markedly improve the sludge dispersancy-varnish inhibiting properties of lubricating oils employed for crankcase lubrication of internal combustion engines.

There are two principle environments which are encountered by automotive crankcase lubricants, i.e. cyclical high and low temperatures from stop-and-go driving and continuous high temperatures from extended operation of the automobile over long distances. Each of these environments poses a primary problem which should be solved if a lubricant is to be regarded as satisfactory. These problems result from varying proportions of foreign particles including dirt and oil decomposition products in the lubricant from breakdown of the oil. The presence of water and precursors of sludge in lubricating oil seems to depend largely on the operating temperature of the oil. Although at high temperatures the water will be evaporated, breakdown of the oil is accelerated. At low temperatures, water will accumulate and so consequently will provoke the sludging. In ordinary stop-and-go driving, the crankcase lubricant will be alternately hot and cold so that the formation of sludge is a serious problem.

Another principle problem in addition to the sludge which must be overcome by a satisfactory lubricant is varnish deposition which results from the operation of the engine at continuous high temperatures. In such an environment, oil breakdown results in the formation of acidic materials which in themselves corrode the metal surfaces of the bearings, pistons, etc., as well as catalyze the decomposition of the lubricating oil which decomposition is manifested in hard, carbonaceous deposits which accumulate in the piston ring groove and form a varnish on the piston skirts and other metal surfaces.

During the past decade, ashless sludge dispersants have become increasingly important, primarily in improving the performance of lubricants in keeping the engine clean of deposits and permitting extended crankcase oil drain periods while avoiding the undesirable environmental impact of the earlier used metal-containing additives. Most commercial ashless dispersants fall into several general categories. In one category, an amine or polyamine is attached to a long-chain hydrocarbon polymer (the oil solubilizing portion of the molecule), usually polyisobutylene through an acid group, such as a dicarboxylic acid material such as polyisobutenyl succinic anhydride, by forming amide or imide linkages such as described in U.S. Pat. No. 3,272,746 and may include the reaction product of such materials with boron (see U.S. Pat. No. 3,254,025).

Another category is the oil-soluble polyol esters, usually the reaction products of hydrocarbon substituted succinic anhydride, e.g., polyisobutenylsuccinic anhydride, with polyols e.g. pentaerythritol, which have been taught as ashless sludge dispersants (see U.S. Pat. No. 3,381,022). Further, the reaction products of said polyol esters with boron compounds are said to be useful as detergents for lubricating oils (see U.S. Pat. No. 3,533,945).

SUMMARY OF THE INVENTION

As noted above, the prior art teaches that oil-soluble additives of the acylated nitrogen type and the polyol ester type are each useful for lubricating oils.

It has now been found that the combination of an oil-soluble polyalkenyl polyol ester compound, having a number average molecular weight of about 1,300 to 8,000, preferably from about 1,400 to 6,000, optimally from about 1,500 to 5,000, preferably polyol polybutenyl succinate (obtained from the reaction of polybutenyl succinic anhydride and a polyol such as pentaerythritol) and an oil-soluble acyl nitrogen compound having a number average molecular weight of about 1,300 to 8,000, preferably about 2,000 to 6,000, optimally 2,500 to 5,000, and preferably polybutenyl succinimide (obtained from the reaction of polybutenyl succinic anhydride and 0.5 molar equivalent of an alkylene polyamine) exhibits synergistic behavior in dispersancy and/or varnish inhibition when employed in a ratio of one part per weight of the polyol ester compound to from 0.2 to 4 preferably 1 to 3 parts, by weight of the acyl nitrogen compound when said combination is present in at least a dispersing amount in a lubricating oil.

Thus in its broadest concept, the subject matter of the invention is a lubricating oil composition comprising a major amount of lubricating oil and a minor but dispersing amount of a dispersing varnish inhibiting combination of: (a) one part by weight of an oil-soluble polyol ester product having a number average molecular weight (hereinafter designated ($\overline{M}_n$) of from about 1,300 to about 8,000 obtained from the reaction of one molar proportion of a hydrocarbyl substituted $C_4$–$C_{10}$ monounsaturated dicarboxylic acid material and from about 1 to 2, preferably from about 1.0 to 1.5, optimally from 1.05 to 1.15, molar proportions of a polyol containing a total of 4 to 10 carbons and represented by the formula:

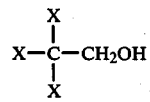

wherein X is hydrogen, an alkyl or hydroxy alkyl group, with at least one of the X substituents being a hydroxy alkyl group and preferably all of the X substituents being a hydroxyl alkyl group of the structure —$(CH_2)_nOH$, wherein n is 1 to 3; and, (b) from 0.2 to 4 parts by weight of an oil-soluble acyl nitrogen compound having a ($\overline{M}_n$) of from about 1,300 to 8,000 characterized by the presence within its structure of a substantially saturated hydrocarbon-substituted polar group selected from the class consisting of acyl, acylimidoyl, and acyloxy radicals wherein the substantially saturated hydrocarbon substituent contains at least about 80 aliphatic carbon atoms and a nitrogen-containing group characterized by a nitrogen atom attached directly to said polar radical.

In preferred form, the combination is limited to said polyol ester product and nitrogen compound wherein both are derived from hydrocarbyl substituted dicarboxylic acid materials wherein said hydrocarbyl substituent has a ($\overline{M}_n$) ranging from about 1,200 to 5,800 optimally about 1,300 to 4,800, i.e. both the acylated nitrogen compound and the polyol ester product are derived therefrom.

DETAILED DESCRIPTION OF THE INVENTION

The hydrocarbyl substituted dicarboxylic acid material, i.e., acid or anhydride, or ester which is used to produce both classes of dispersants includes alpha-beta unsaturated $C_4$ to $C_{10}$ dicarboxylic acid, or anhydrides or esters thereof, such as fumaric acid, itaconic acid, maleic acid, maleic anhydride, chlormaleic acid, dimethyl fumarate, etc., which are substituted with a hydrocarbyl group, usefully a hydrocarbon chain containing at least 80 carbons (branched or unbranched) and includes long hydrocarbon chains, generally an olefin polymer chain.

In general, these hydrocarbyl substituted dicarboxylic acid materials and their preparation are well known in the art, for example see U.S. Pat. Nos. 3,219,666; 3,172,892; 3,272,746; the aforementioned prior art patents; as well as being commercially available, e.g., polyisobutylene succinic anhydride.

The dicarboxylic acid material can be illustrated by an alkenyl substituted anhydride which may contain a single alkenyl radical or a mixture of alkenyl radicals variously bonded to the cyclic succinic anhydride group, and is understood to comprise such structures as:

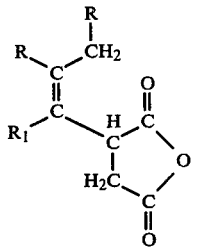

wherein R is hydrogen or lower hydrocarbyl and $R_1$ is hydrocarbyl or substituted hydrocarbyl having from 80 to about 600 and more carbons, and preferably from 85 to about 400 carbons. The anhydrides can be obtained by well-known methods, such as the Ene reaction between an olefin and maleic anhydride or halo-succinic anhydride or succinic ester (U.S. Pat. No. 2,568,876). In branched olefins, particularly branched polyolefins, R may be hydrogen or methyl and $R_1$ at least a $C_{80}$ long chain hydrocarbyl group. However, the exact structure may not always be ascertained and the various R and $R_1$ groups cannot always be precisely defined in the Ene products from polyolefins and maleic anhydride.

Suitable olefins include butene, isobutene, pentene, decene, dodecene, tetradecene, hexadecene, octadecene, eicosene, and polymers of propylene, butene, isobutene, pentene, decene and the like, and halogen-containing olefins. The olefins may also contain cycloalkyl and aromatic groups.

With 2-chloromaleic anhydride and related acylating agents, alkenylmaleic anhydride reactants are formed. Derivatization of these reactants also afford useful imide or oxazoline products.

Preferred olefin polymers for reaction with the unsaturated dicarboxylic acids are polymers comprising a major molar amount of $C_2$ to $C_5$ monoolefin, e.g., ethylene, propylene, butylene, isobutylene and pentene. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor amount of the copolymer monomers, e.g., 1 to 20 mole % is a $C_4$ to $C_{18}$ non-conjugated diolefin, e.g., a copolymer of isobutylene and butadiene; or a copolymer of ethylene, propylene and 1,4-hexadiene; etc.

The olefin polymers will usually have $(\overline{M}_n)$s within the range of about 1,200 and about 8,000, more usually between about 1,200 and about 6,000. Particularly useful olefin polymers have $(\overline{M}_n)$s of about 1,300 to 2,500 with approximately one terminal double bond per polymer chain. An especially valuable starting material for a highly potent dispersant additive are polyalkenes e.g., polyisobutylene, having predominantly from about 85 to 95 carbons.

THE POLYOL

The polyhydric alcohol used to react with the dicarboxylic acid material can have a total of 4 to 10 carbon atoms and can be represented by the formula:

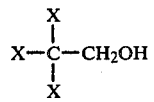

wherein X is hydrogen, an alkyl, or hydroxy alkyl group, with at least one of the X substituents being a hydroxy alkyl group and preferably all of the X substituents being a hydroxy alkyl group of the structure $-(CH_2)_nOH$, wherein n is 1 to 3.

Examples of such polyols are illustrated by ethylene glycol, diethylene glycol, triethylene glycol, tetraethylene glycol, dipropylene glycol, tripropylene glycol, dibutylene glycol, tributylene glycol, and other alkylene glycols in which the alkylene group contains from two to about eight carbon atoms. Other useful polyhydric alcohols include glycerol, monooleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, celluloses, etc., likewise may yield the esters of this invention. The carbohydrates may be exemplified by glucose, fructose, sucrose, rhamnose, mannose, glyceraldehyde, and galactose.

An especially preferred class of polyhydric alcohols are those having at least three hydroxyl groups, such as pentaerythritol, dipentaerythritol, tripentaerythritol, sorbitol and mannitol. Solubility of some polyhydric alcohols may be increased by esterifying some of the hydroxyl groups with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, and dodecanoate of erythritol. Because of its effectiveness, availability, and cost, pentaerythritol is particularly preferred.

ESTERIFICATION CONDITIONS

The esters of the invention may be readily prepared by any one of several methods including, if desired, the esterification in the presence of a catalyst. The method which is preferred because of the superior properties of the esters it produces and their formation of in very high yield, can be effected by adding from about 1 to 2 moles e.g. 1.05 to 1.15 moles of the aforesaid polyol per mole of the dicarboxylic acid material with or without an inert diluent and heating the mixture at 100°-240° C., preferably 200°-220° C. until reaction is complete by infra-red analysis of the product showing maximal absorption for ester.

The water formed as a by-product is removed by distillation as the esterification proceeds or may be removed by sparging with nitrogen after esterification is complete. A solvent preferably is used in the esterification to facilitate mixing and temperature control. It also facilitates the removal of water from the reaction mixture. The useful solvents which are inert solvents in the above reaction include hydrocarbon oils, e.g. mineral lubricating oil, kerosene, neutral mineral oils, xylene, halogenated hydrocarbons, e.g., carbon tetrachloride, dichlorobenzene, tetrahydrofuran, etc.

In some instances it is advantageous to carry out the esterification in the presence of a catalyst such as sulfuric acid, Amberlyst 15 (a sulfonated polystyrene sold by Dow Chemical Co. of Midland, Mich.), benzene sulfonic acid, p-toluene sulfonic acid, phosphoric acid, etc. The amount of the catalyst in the reaction may be as little as 0.01% (by weight of the reaction mixture), more often from about 0.1% to about 5%.

The relative proportions of the dicarboxylic acid material reactant and the polyhydroxy reactant which are to be used depend to a large measure upon the type of the product desired and the number of hydroxyl groups present in the molecule of the hydroxy reactant. Preferably, the formation of the pentaerythritol ester, involves the use of a slight molar excess of the polyol for each mole of dicarboxylic material i.e. from 1.05 to 1.25 moles of pentaerythritol per mole of polyisobutenyl succinic anhydride.

ACYL NITROGEN COMPOUND

The acyl nitrogen compound is of that class of oil-soluble dispersants broadly described in U.S. Pat. No. 3,272,746 (it is incorporated herein by reference thereto) as an oil-soluble acylated nitrogen compound characterized by the presence within its structure of a substantially saturated hydrocarbon-substituted polar group selected from the class consisting of acyl, acylimidoyl, and acyloxy radicals wherein the substantially saturated hydrocarbon substituent contains at least about 80 aliphatic carbon atoms and a nitrogen-containing group characterized by a nitrogen atom attached directly to said polar radical. For the purposes of this invention, these acyl nitrogen compounds have a ($\overline{M}_n$) ranging from about 1,300 to 8,000, preferably from about 2,000 to 6,000 and optimally from about 2,500 to 5,000. All ($\overline{M}_n$) values set forth in this specification have been determined by Vapor Pressure Osmometry (VPO).

The relative polar groups of the acyl nitrogen compound are represented by the structural configurations as follows:

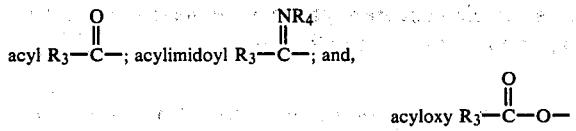

where $R_3$ is the substantially saturated hydrocarbon substituent extensively discussed earlier as the hydrocarbyl (including the preferred alkenyl) substituent of the dicarboxylic acid material and $R_4$ represents a hydrogen radical or a hydrocarbyl group (including polar substituted hydrocarbyls, e.g. Cl substituted).

The nitrogen-containing group of the acylated nitrogen compositions of this invention is derived from compounds characterized by a radical having the structural configuration

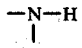

and the two remaining valences of the nitrogen atom of the

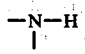

above radical preferably are satisfied by hydrogen, amino, or organic radicals bonded to said nitrogen atom through direct carbon-to-nitrogen linkages. Thus, the compounds from which the nitrogen-containing group may be derived include aliphatic amines, aromatic amines, heterocyclic amines or carbocyclic amines. The amines may be primary or secondary amines and preferably are polyamines such as alkylene amines, arylene amines, cyclic polyamines, and the hydroxy-substituted derivatives of such polyamines.

The preferred acyl nitrogen compounds are essentially described as the imides and diimides, preferably diimides, resulting from the reaction of 1 to 2.5, preferably about 2.0 to 2.2, molar proportions of the dicarboxylic acid material with one molar proportion of a nitrogen compound having one or more amino groups. Such a preferred compound can be represented by the structural formula:

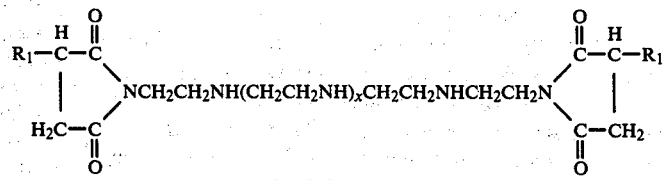

wherein X is a number from 0 to 5, etc., when 2 molar proportions of the dicarboxylic acid material is reacted with one molar proportion of said nitrogen compound having one or more amine groups and $R_1$ is the same as earlier defined.

Useful nitrogen compounds include mono- and polyamines of about 2 to 60, e.g. 3 to 20 total carbon atoms and about 1 to 12, e.g. 2 to 6 nitrogen atoms in the molecule. The amine compounds may be hydrocarbyl amines or may include hydroxy groups, alkoxy groups, amide groups or may be cyclic in structure such as imidazolines and the like. Preferred amines both as noted above generally and for preparation of said imides and diimides are aliphatic, saturated amines including those of the general formula:

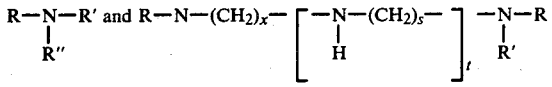

wherein R, R' and R'' are independently selected from the group consisting of hydrogen; $C_1$ to $C_{12}$ straight or branched chain alkyl radicals; $C_1$ to $C_{12}$ alkoxy $C_2$ to $C_6$ alkylene radicals; $C_2$ to $C_{12}$ hydroxy or amino alkylene radicals; and $C_1$ to $C_{12}$ alkylamino $C_2$ to $C_6$ alkylene radicals; s is a number of from 2 to 6, preferably 2 to 4; and t is a number of from 0 to 10, preferably 2 to 6.

Non-limiting examples of suitable amine compounds include: mono- and di- tallow amines; 1,2-diaminoethane; 1,3-diaminopropane; 1,4-diaminobutane; 1,6-diaminohexane; diethylene triamine; triethylene tetramine, tetraethylene pentamine; 1,2-propylene diamine; di-(1,2-propylene) triamine, di-(1,3-propylene) triamine, N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine; tris-hydroxymethyl methylamine, diisopropanol amine, and diethanol amine.

Other useful amine compounds include: alicyclic diamines such as 1,4-bis-(aminomethyl) cyclohexane, and heterocyclic nitrogen compounds such as imidazolines and N-aminoalkyl piperazines of the general formula:

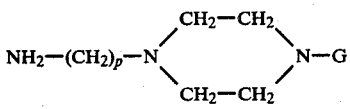

wherein G is independently selected from the group consisting of hydrogen and Ω aminoalkylene radicals of from 1 to 3 carbon atoms; and p is an integer of from 1 to 4. Non-limiting examples of such amines include 2-pentadecyl imidazoline; N-(2-aminoethyl) piperazine; N-(3-aminopropyl) piperazine; and N,N'-di-(2-aminoethyl)piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly (ethyleneamines) compounds having a composition approximating tetraethylene pentamine (used for the preparation of the acyl nitrogen compounds of the subsequent Examples herein) are available commercially under the trade name Dow E-100, marketed by Dow Chemical Co., Midland, Mich. Similar material may be made by the polymerization of aziridine, 2-methyl aziridine and acetidine.

Still other amines with amino groups separated by hetero atom chains such as polyethers or sulfides can be used.

Amination of the dicarboxylic acid material is usefully carried in a solution reaction with the dicarboxylic acid material dissolved in a solvent such as mineral oil. The formation of the imide dispersants in high yield can be effected by adding from about 0.4 to 1, preferably about 0.45 to 0.5, molar proportions of alkylene polyamine per molar proportion of dicarboxylic acid material of the nitrogen compound to said solution and heating the mixture at 140° C. to 165° C. until the appropriate amount of water of reaction is evolved.

BORATED DERIVATIVES

In some applications, it is useful to borate the polyol ester additive and/or acyl nitrogen dispersant additive to provide enhanced varnish-inhibition activity.

A. The borated polyol ester additive which appears hydrolytically stable can be realized by condensing a boron compound, e.g. boric acid, with the hydroxy groups of the polyol group of the oil-soluble hydrocarbyl substituted dicarboxylic polyol ester to provide about 0.1 to 2.0, preferably 0.3 to 1.0, wt. % of boron (as a borate ester), present in the borated additive.

The boron compounds useful in the reaction with the oil-soluble polyol ester additive include boron oxide, boron oxide hydrate, boron acids such as boronic acid [e.g., alkyl-$B(OH)_2$ or aryl-$B(OH)_2$] and boric acids, preferably $H_3BO_3$, and esters of such boron acids.

Specific examples of boronic acids include methyl boronic acid, phenyl-boronic acid, cyclohexyl boronic acid, p-heptylphenyl boronic acid and dodecyl boronic acid.

The boric acid esters include mono-, di- and tri-substituted organic esters of boric acid with alcohols or phenols such as, e.g., butanol, octanol, cyclohexanol, cyclopentanol, ethylene glycol, 1,3-butanediol, 2,4-hexanediol, polyisobutene substituted phenols. Lower alcohols, 1,2-glycols, and 1,3-glycols, i.e., those having less than about 8 carbon atoms, are especially useful for preparing the boric acid esters for the purpose of this invention.

The general process of forming the oil-soluble borated polyol esters of the invention by reacting the polyol ester with the boron containing compound is usually carried out by heating a mixture of the reactants at from about 100° C. to about 250° C., preferably within the range from about 125° C. to about 250° C. The use of a solvent such as benzene, toluene, naphtha, mineral oil, xylene, n-hexane, or the like is often desirable in the above process to facilitate the control of the reaction temperature and removal of water; mineral oil is preferred to facilitate the products use as a lubricating oil additive.

The oil-soluble polyol esters react readily with the boron compounds, e.g., boric acid at these mildly elevated temperatures to form the boron esters. When the polyol ester in the reaction has three available hydroxyl groups, the polyol ester may be reacted with the boron compound in a molar ratio of 1:1 to 1:3. If water of reaction is formed in the reaction as with the preferred boric acid, it is necessary to remove all or a part of it from the reaction mixture by separating it overhead, either by blowing with an inert gas such as nitrogen or by simple azeotropic distillation and to keep the temperature above 100° C. to facilitate stripping out of the water.

B. The acyl nitrogen dispersant is readily borated as generally taught in U.S. Pat. No. 3,254,025 (incorporated herein by reference thereto). This is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 10 atomic proportions of boron for each atomic proportion of nitrogen of said acylated nitrogen composition. The nitrogen dispersants of the inventive combination contain from about 0.1 to 2.0, preferably 0.2 to 0.8 wt. % boron based on the total weight of said borated acyl nitrogen compound. The boron, which appears to be in the product as dehydrated boric acid polymers (primarily $HBO_2)_3$), attaches chemically to the dispersant imides and diimides as amine salts e.g. the metaborate salt of said diimide.

Treating is readily carried by adding from about 1 to 3 wt. % (based on the weight of said acyl nitrogen compound) of said boron compound, preferably boric acid which is most usually added as a slurry to said acyl nitrogen compound and heating with stirring and at from about 135° C. to 165° C. for from 1 to 5 hours followed by nitrogen stripping at said temperature ranges. Filter the borated product, if desired.

THE POLYOL ESTER REACTION PRODUCT AND ACYL NITROGEN COMPOUND COMBINATION

The combination of oil-soluble dispersants according to the invention can be incorporated in a wide variety of lubricants. They can be used in lubricating oil compositions, such as automotive crankcase lubricating oils, automatic transmission fluid, etc., in active ingredient concentrations generally within the range of about 0.5 to 10 wt. %, for example, 1 to 5 wt. %, preferably 1.5 to 3 wt. % of the total composition. As noted in general, the additive combination of the invention will comprise one part by weight of the polyol ester reaction product per about 0.2 to 4, preferably 1 to 3, optimally 2 to 3 parts by weight of said acyl nitrogen compound. Conventionally the dispersants are admixed with the lubricating oils as concentrates which are usually about 50% weight of the additive compound dissolved in mineral oil. The lubricating oil to which the synergistic combination can be added includes not only hydrocarbon oils derived from petroleum but also includes synthetic lubricating oils such as polyethylene oils; alkyl esters of dicarboxylic acids; complex esters of dicarboxylic acid, polyglycol and alcohol; alkyl esters of carbonic or phosphoric acids; polysilicones; fluorohydrocarbon oils; and, mixtures of lubricating oils and synthetic oils in any proportion, etc. The term "lubricating oil" for this disclosure includes all the foregoing. The useful combination may be conveniently dispensed as a concentrate of 10 to 80 wt. % of said synergistic combination in 20 to 90 wt. % of mineral oil, e.g. Solvent 150 N oil with or without other additives being present. In the above compositions or concentrates, other conventional additives may also be present including dyes, pour point depressants, antiwear agents such as tricresyl phosphate or zinc dialkyl dithiophosphates of 3 to 8 carbon atoms in the alkyl groups, antioxidants such as n-phenyl-alphanaphthylamine, tertiary-octyl phenol sulfide, and 4,4'-methylene bis (2,6-di-tert. butyl phenol), viscosity index improvers such as ethylene-propylene copolymers, polymethacrylates, polyisobutylene, alkyl fumarate-vinyl acetate copolymers and the like, de-emulsifiers such as polysiloxanes, ethoxylated polymers and the like. As used herein the wt. % values are based on the total weight of the oil composition.

It has been believed that in those combinations of the polyol ester reaction product and acyl nitrogen compounds according to this invention that when the $(\overline{M}_n)$ of said polyol ester is about 30% to 60% of the $(\overline{M}_n)$ acyl nitrogen compound exceptionally potent dispersant-varnish inhibition is imparted to the lubricating oil, e.g. $(\overline{M}_n)$ of ~1,500 for the polyol ester and ~3,000 for the acyl nitrogen.

A highly useful concentrate according to this invention is about 50 wt. % diluent as a neutral mineral oil, e.g. S150N, and 50 wt. % of the invention combination in preferred form which the products of Examples 1 and 2 in a weight ratio of one part of said polyol ester reaction product and one to three parts of said acyl nitrogen compound. Such a concentrate can be represented thus by about 50 wt. % of mineral oil diluent, about 17% of the polyol ester of poly- (isobutenyl) succinic anhydride wherein said poly (isobutenyl) has a $(\overline{M}_n)$ of about 1,300 and about 33 wt. % of borated tetra-ethylene pentamino-diimide of poly (isobutenyl) succinic anhydride wherein said poly (isobutenyl) has a $(\overline{M}_n)$ of about 1,300 and said concentrate contains about 1.3 wt. % nitrogen and about 0.2 wt. % boron.

This invention will be further understood by reference to the following examples, which include preferred embodiments of the invention.

EXAMPLE 1

A mixture of one mole of polyisobutenyl succinic anhydride having a Saponification No. of 103, 1,000 ml. of mineral lubricating oil (Solvent 150 Neutral) as solvent, and 150 gm. (1.1 mole) of pentaerythritol was charged into a glass reactor fitted with thermometer, stirrer and a Deane-Starke moisture trap, and heated under nitrogen. Heating at about 210° C. for three hours after which a nitrogen sparge was used for 1 hour at 210° C. to remove the water to a level less than about 1 wt. %. The product had a $(\overline{M}_n)$ of about 1,500 and a total acid number (TAN) as measured by ASTMD-664 of 4.

The polyisobutenylsuccinic anhydride used herein (also used in Example 2) was prepared by conventional technique, namely the reaction of chlorinated polyisobutylene having a chlorine content of about 3.5 wt. %, based on the weight of chlorinated polyisobutylene, and an average of 93 carbon atoms in the polyisobutylene group, with maleic anhydride at about 200° C.

EXAMPLE 2

A borated derivative of the reaction product of polyisobutenyl succinic anhydride and an alkylene polyamine (Dow E-100) was prepared by first condensing 2.1 moles of polyisobutenyl succinic anhydride, having a Saponification Number of 103 and a $(\overline{M}_n)$ of about 1,300, dissolved in Solvent Neutral 150 mineral oil to provide a 50 wt. % solution with 1 mole of said alkylene polyamine (hereafter noted as PAM). The polyisobutenyl succinic anhydride solution was heated to about 150° C. with stirring and the PAM was charged into the reaction vessel over a 4-hour period which was thereafter followed by a 3-hour nitrogen strip. The temperature was maintained from about 140° C. to 165° C. during both the reaction with the PAM and the subsequent stripping. While the resulting reaction product was maintained at a temperature of from about 135° to about 165° C. a slurry of 1.4 moles of boric acid in mineral oil was added over a 3-hour period which was there-after followed by a final 4-hour nitrogen strip. After filtration and rotoevaporation, the concentrate (50 wt. % of the reaction product) contained about 1.5 wt. % nitrogen and 0.3 wt. % boron. The product has a $(\overline{M}_n)$ of about 3,000.

EXAMPLE 3

Five fully formulated lubricating oil blends were prepared by blending 5 weight percent of the concentrate of Example 2, 3.5 and 4.5 weight percents of the concentrate of Example 1 and 3.5 and 4.0 weight percent of a 33/66 mixture of the concentrate of Example 1 and Example 2, respectively, with a lubricating oil blend of two neutral base oils and formulated with about 1.6 wt. % metal detergent (calcium sulfonate overbased to a 400 TBN), 1.3 wt. % zinc dialkyl dithiophosphate and 0.12 wt. % isoprene-styrene polymer viscosity index improver to provide a fully formulated SAE 10W-40 lubricating oil.

Each of the blends prepared as described above was subjected to the MS Sequence VC Engine Test which is a test well known in the automotive industry. The test is run in a Ford engine of 302 cubic inch displacement following the procedure described in the publication entitled "Multi-Cylinder Test Sequences for Evaluating Automotive Engine Oil" (ASTM Special Publication 315-E). At the end of each test, various parts of the engine are rated on a merit basis wherein 10 represents a perfectly clean part, and lesser numbers represent increasing degrees of deposit formation. The various ratings are then totaled and averaged on the basis of 10 as a perfect (completely clean) rating. The results obtained with the five blends described above are given in Table I.

TABLE I

| | MS SEQUENCE VC TEST RESULTS MERIT RATINGS (BASIS 10) | | | | | |
|---|---|---|---|---|---|---|
| | 5.0 wt. % Concn. of Ex. 2 | 4.5 wt. % Concn. of Ex. 1 | 3.5 wt. % Concn. of Ex. 1 | 3.5 wt. % of 2 Parts Concn. Ex. 2 to 1 Pt. Concn. of Ex. 1 | 4.0 wt. % 2 Pts. Concn. Ex. 2 to 1 pt. Concn. Ex. 1 | Passing Limits For SE Quality Oils |
| Sludge | 8.14 | 8.9 | 9.18 | 8.61 | 8.97 | 8.5 |
| Ave. Varnish | 8.21 | 8.3 | 8.17 | 8.18 | 8.36 | 8.0 |
| Piston Skirt Varnish | 7.8 | 7.9 | 7.04 | 7.92 | 8.0 | 7.9 |

Concn. represents Concentrate.

The data of Table I shows that the combination of dispersants has synergistic activity in the MS VC Engine Test both as to average varnish and piston skirt varnish merit ratings.

The inventive combination also provides rust inhibition properties to formulate lubricating oils generally superior to comparable amounts of known acyl nitrogen dispersants.

It is to be understood that the examples present in the foregoing specification are merely illustrative of this invention and are not intended to limit it in any manner, nor is the invention to be limited by any theory regarding its operability. The scope of the invention is to be determined by the appended claims.

The concentration of boron in lubricating oils according to this invention ranges from about 0.001 to 0.02, preferably 0.002 to 0.01, wt. % based on the total weight of the lubricating oil composition.

What is claimed is:

1. A lubricating oil composition comprising a major amount of lubricating oil and a minor but dispersing amount of a dispersing and synergistic varnish inhibiting combination of: (a) one part by weight of an oil-soluble polyol ester dispersant which is the reaction product having a number average molecular weight of from about 1,300 to about 8,000 obtained from the reaction of one molar proportion of a hydrocarbyl substituted $C_4$–$C_{10}$ monounsaturated dicarboxylic acid material and from about 1 to about 2 molar proportions of a polyol containing a total of 4 to 10 carbons and represented by the formula:

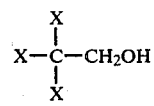

wherein X is hydrogen, an alkyl, or hydroxy alkyl group, with at least one of the X substituents being a hydroxy alkyl group of the structure $-(CH_2)_nOH$, wherein n is 1 to 3; and (b) from 0.25 to 4 parts by weight of an oil-soluble borated acylated nitrogen dispersant compound having a number average molecular weight ranging from about 1,300 to 8,000 characterized by the presence within its structure of a substantially saturated hydrocarbon-substituted polar group selected from the class consisting of acyl, acylimidoyl, and acyloxy radicals wherein the substantially saturated hydrocarbon substituent contains at least about 80 aliphatic carbon atoms and a nitrogen-containing group characterized by a nitrogen atom attached directly to said polar radical.

2. A composition according to claim 1 wherein said combination is present in from about 0.5 to 10 wt. % based on the total weight of said composition, said hydrocarbyl substituted dicarboxylic acid material is poly(alkenyl) succinic anhydride with said poly(alkenyl) substituent having a number average molecular weight of from about 1,200 to about 5,800, said substantially saturated hydrocarbon-substituted polar group is poly(alkenyl) succinic anhydride with said poly(alkenyl) substituent having a number average molecular weight of from about 1,200 to about 5,800 and said polyol is pentaerythritol and said nitrogen containing group being an alkylene polyamino substituent having from 2 to 60 carbon atoms and from 2 to 6 nitrogen atoms.

3. A composition according to claim 2 wherein said acylated nitrogen compound is borated with a boron compound selected from the group consisting of boron oxides, boron halides, boron acids and esters of boron acids, said composition thereby containing from 0.001 to 0.02 weight percent boron.

4. A composition according to claim 2 wherein both said poly(alkenyl) substituents have a ($\overline{M}_n$) of from about 1,300 to about 4,800, said polyol ester reaction product has a ($\overline{M}_n$) ranging from 1,500 to 5,000, said acyl nitrogen compound has a ($\overline{M}_n$) ranging from 2,000 to 6,000, and said oil composition contains from about 1 to 5 wt. %, based on the total weight of said compositions of said combination which consists of one part by weight of (a) to from about 1 to 3 parts by weight of (b).

5. A composition according to claim 4 wherein said polyol ester reaction product is obtained from the reaction of one molar proportion of a poly(butenyl) $C_4$–$C_{10}$ monounsaturated dicarboxylic acid material with said poly (butenyl) substituent having a ($\overline{M}_n$) of about 1,300 and about one molar proportions of said pentaerythritol at a temperature of from about 100° C. to about 240° C. until cessation of water evolution and said acyl nitrogen compound is obtained from the reaction of about two molar proportions of a poly (butenyl) substituted succinic anhydride material with said poly(butenyl) substituent having a ($\overline{M}_n$) of about 1,300 with about one molar proportion of tetraethylene pentamine at a temperature of from about 140° C. to about 165° C. until about 2 molar proportions of water has evolved followed by condensation with boric acid at a temperature of from about 135° C. to about 165° C.

6. A concentrate comprising from about 20% to about 90% by weight of mineral oil and from about 10% to about 80% by weight of a synergistic varnish inhibiting combination of: (a) a polyol ester dispersant having a ($\overline{M}_n$) of about 1,500 formed by reacting polyisobutenyl succinic anhydride with pentaerythritol; and, (b) a borated dispersant having a ($\overline{M}_n$) of about 3,000 prepared by reacting polyisobutenyl succinic anhydride with an alkylene polyamine and boric acid, the weight ratio of (a) to (b) ranging from about 1 to 3.

* * * * *